US008337073B2

(12) United States Patent
Roberts

(10) Patent No.: US 8,337,073 B2
(45) **Date of Patent: *Dec. 25, 2012**

(54) SPIRALING BOWL

(76) Inventor: Michael L. Roberts, Corona Del Mar, CA (US)

( * ) Notice: Subject to any disclaimer, the term of this patent is extended or adjusted under 35 U.S.C. 154(b) by 493 days.

This patent is subject to a terminal disclaimer.

(21) Appl. No.: 12/636,728

(22) Filed: Dec. 12, 2009

(65) Prior Publication Data

US 2011/0141842 A1 Jun. 16, 2011

(51) Int. Cl.
*A47G 19/02* (2006.01)

(52) U.S. Cl. ..... 366/130; 220/575

(58) Field of Classification Search ..... 366/130, 366/225, 228; 220/574, 575; 206/219; D7/555
See application file for complete search history.

(56) References Cited

U.S. PATENT DOCUMENTS

| | | | | | |
|---|---|---|---|---|---|
| D38,779 | S | * | 9/1907 | Wilhelm et al. | D7/555 |
| 1,100,298 | A | * | 6/1914 | Haas | 220/575 |
| 1,379,519 | A | * | 5/1921 | Bjornsen | 220/575 |
| 2,207,417 | A | * | 7/1940 | Smith | 220/575 |
| 2,625,020 | A | * | 1/1953 | Oliver | 220/771 |
| D176,824 | S | * | 1/1956 | Sacia et al. | D7/555 |
| D185,067 | S | * | 5/1959 | Clark | D7/546 |
| 4,069,940 | A | | 1/1978 | Naimoli | |
| D283,096 | S | * | 3/1986 | Uhrik | D7/555 |
| D298,898 | S | * | 12/1988 | Roshau | D7/566 |
| 4,986,433 | A | * | 1/1991 | Davis | 220/23.8 |
| 5,169,023 | A | * | 12/1992 | Heiberg et al. | 220/574 |
| 5,172,826 | A | * | 12/1992 | Celaya | 220/574 |
| 5,209,348 | A | | 5/1993 | Schafer, III | |
| 5,676,275 | A | * | 10/1997 | Khattar | 220/575 |
| D386,358 | S | * | 11/1997 | Pfeilsticker | D7/555 |
| 5,927,538 | A | | 7/1999 | Collins | |
| D467,125 | S | * | 12/2002 | Orr et al. | D7/541 |
| D515,866 | S | * | 2/2006 | Wiedmeyer et al. | D7/396.1 |
| D587,971 | S | * | 3/2009 | Peabody et al. | D7/555 |
| D633,340 | S | * | 3/2011 | Roberts | D7/549 |
| D652,683 | S | * | 1/2012 | Munoz | D7/555 |
| 2006/0207993 | A1 | * | 9/2006 | Copeland | 220/574 |
| 2008/0290097 | A1 | * | 11/2008 | Fischell et al. | 220/575 |
| 2011/0141842 | A1 | * | 6/2011 | Roberts | 366/130 |
| 2011/0284119 | A1 | * | 11/2011 | Andrews | 141/1 |

FOREIGN PATENT DOCUMENTS

| | | | | |
|---|---|---|---|---|
| GB | 2265816 | A | * | 10/1993 |
| GB | 2355645 | A | * | 5/2001 |
| GB | 2452940 | A | * | 3/2009 |

* cited by examiner

*Primary Examiner* — Charles E Cooley
(74) *Attorney, Agent, or Firm* — Cislo & Thomas, LLP

(57) ABSTRACT

A particular continuous downward spiraling cereal bowl is disclosed which allows for exceptional control over a mixing process by keeping dry substances separated from liquids until mixed in user defined portions and timeframes. The disclosure comprises a slightly asymmetrically round bowl consisting of two contiguous areas with an inner surface that continually slopes downward between the two areas and an S-shaped guide rail between these two areas. The shape of the guide rail is curved in order to hold cereal in the upper part of the spiral at a level above the fill line of liquid held in the lower portion of the spiral. In the preferred embodiment, the bowl further comprises a thumb groove underneath the inner surface of the dry area which may serve as an embedded handle.

20 Claims, 4 Drawing Sheets

SPIRALING BOWL

FIELD OF THE INVENTION

The present invention relates to the field of kitchenware. More specifically, the invention relates to bowls capable of containing liquids and dry substances simultaneously yet separate until mixed in user defined portions for the purpose of keeping the dry substances in a fresh and crisp state.

BACKGROUND OF THE INVENTION

Health experts agree that breakfast is the most important meal of the day. The health benefits of eating wholesome grains and fiber lead millions of adults and children to start their day by eating cereal with milk. However, a common problem arises in that the crispness of the cereal is extremely fleeting and one must eat quickly to enjoy the meal before it becomes soggy. In addition, eating quickly can lead to digestive disorders. Many cereal manufactures have tried to solve this problem by coating the cereal with additives to inhibit the absorption of liquids but this method often involves undesirable chemicals and sweeteners. Therefore, it is important to keep the cereal enticing and dry by maintaining it in a fresh, crisp state until it is mixed by the user in the user's desired leisurely timeframe and portion size. Until the present disclosure, no bowl has solved this problem in a simple, undivided, singular unit that is both child-friendly and naturally ergonomic by the means of a continual downward spiraling and sloping inner surface with an S-shaped guide rail.

Prior Art has offered many attempts to solve the problem of soggy cereal. All of these attempts involve either completely divided compartments, valves, sieves or multiple connecting parts leading to complicated use and/or disassembly for cleaning. For instance, one example of a bowl is disclosed in U.S. Pat. No. 5,927,538 and describes a cereal bowl with multiple partitions. One of these partitions completely divides the bowl into two compartments while the other partition divides the milk compartment into a general area and a mixing area the size of a spoon. Neither of these partitions touches both the milk and the cereal. Therefore, no actual mixing occurs without a user bringing the cereal from one compartment over the dividing wall and into the mixing area of the milk compartment. This is basically the same as using two separate bowls and requires a great deal of coordination.

As another example, U.S. Pat. No. 5,172,826 discloses a food bowl with a portion of the lower inside being depressed or indented. This allows for remaining bits of food to fall or be pushed into the bottom in order to capture every last bite. However, the design would clearly not keep two ingredients separate from each other mainly due to the fact that no divider or partition exists at all.

Still, other ideas have been described which include using separate pieces to contain the wet and dry ingredients. These solutions come with the additional burden of assembly, disassembly and additional cleaning requirements. Some have tried to solve the instant problem with different sieve type arrangements where the liquid could flow or drip into the solid ingredient. However, until the present disclosure, none have utilized the strategy of mixing the dry ingredient into the wet ingredient by means of a continuous downward spiraling and sloping inner surface and partial guide rail.

The following disclosure provides for a bowl which overcomes all of the foregoing problems with the associated prior art as well as other difficulties which have been known in the art for some time. Additionally, the presently disclosed bowl offers features and solutions that are not known and have never been suggested by prior art.

SUMMARY OF THE INVENTION

A particular continuous downward spiraling cereal bowl is disclosed which allows for exceptional control over a mixing process by keeping dry substances separated from liquids until mixed in user defined portions and timeframes. The disclosure comprises a slightly asymmetrically round bowl consisting of two contiguous areas with an inner surface that continually slopes downward between the two areas and an S-shaped guide rail between these two areas. The shape of the guide rail is curved in order to hold cereal in the upper part of the spiral at a level above the fill line of liquid held in the lower portion of the spiral. The two areas of the spiral, although continually connected by means of their floor and side walls, have different heights at their rim levels and different depths, providing for a natural separation of cereal from liquid at the lower, concave deeper section of the bowl. The bowl may also comprise an inner sidewall of the lower liquid area of the spiral that is more sloped than the inner sidewall of the upper dry area. In another embodiment, the bowl will have different shaped exterior surfaces, feet or stanchions for stability. One of these exterior shapes further comprises a thumb groove underneath the inner surface of the dry area which may serve as an embedded handle.

These and other objectives of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENT

In the following description of the various embodiments, reference is made to the accompanying drawings, which form a part hereof, and in which is shown by way of illustration various embodiments in which the invention may be practiced. It is to be understood that other embodiments may still be utilized and structural and functional modifications may be made without departing from the scope and spirit of the present invention.

Figure 1:
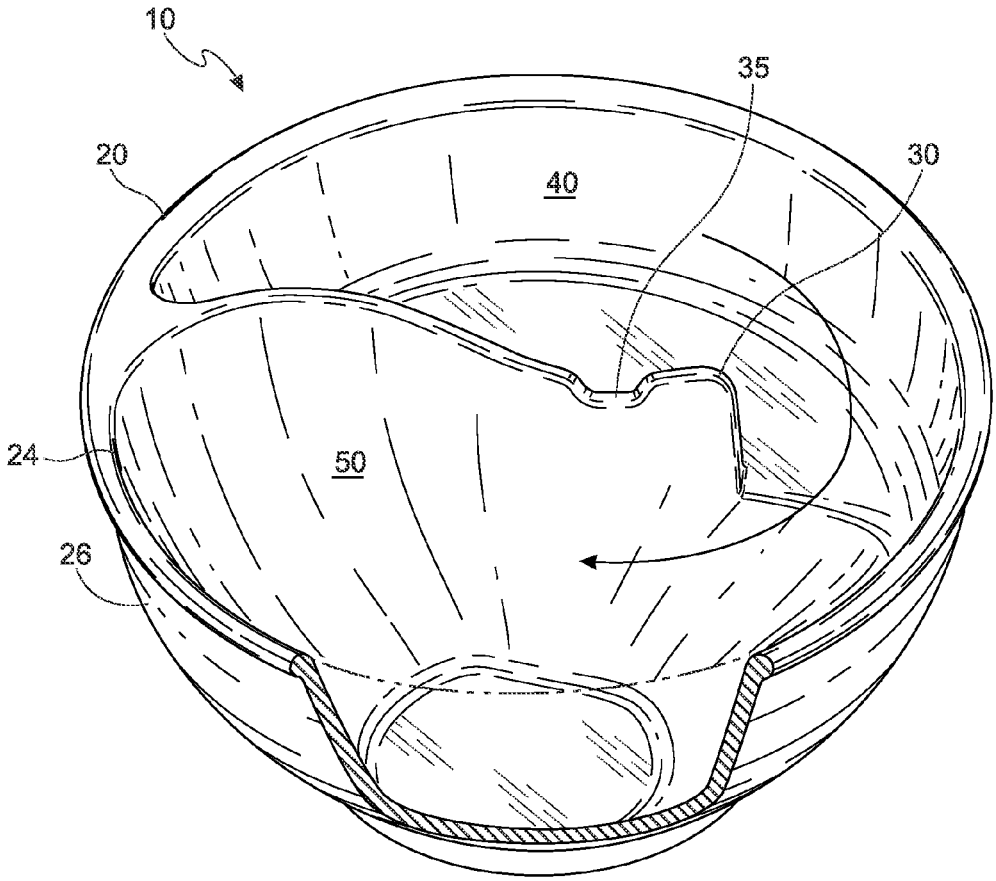
FIG. 1 illustrates a top perspective view of the preferred embodiment of the present disclosure.

Referring to FIG. 1, a top perspective view of the preferred embodiment of the present disclosure is shown. Bowl 10 chiefly comprises rim 20, inner surface 24, outer surface 26, guide rail 30, first area 40 and second area 50. Inner surface 24 provides the ideal pathway for ingredients to slide and/or be pushed from area 40 to area 50. As a key aspect of the present disclosure, the floor of inner surface 24 supplies a continuous, downward sloping spiral around the interior of bowl 10 which is unique to this disclosure. Guide rail 30 acts as a partial divide between first area 40 and second area 50. It provides a partial functional dam that keeps most of ingredients in one area separate from the other until a user desires the ingredients to be mixed, whereby partially propelled by gravity and partially propelled by a utensil, the ingredients can be pushed around one side of guide rail 30. The height of rim 20 slightly decreases while moving around its circumference from first area 40 to second area 50. (see FIG. 3) Paralleling this decrease, the height of guide rail 30 slightly decreases while moving from its base at the connection point with rim 20 to its tip. Bowl 10, itself, can have any dimensions which are capable of holding ingredients to be mixed together. The ingredients can be any combination of solids and/or liquids. Some prime examples of this are mixing cereal with milk, crackers with soup or even toppings with ice cream.

Figure 2:
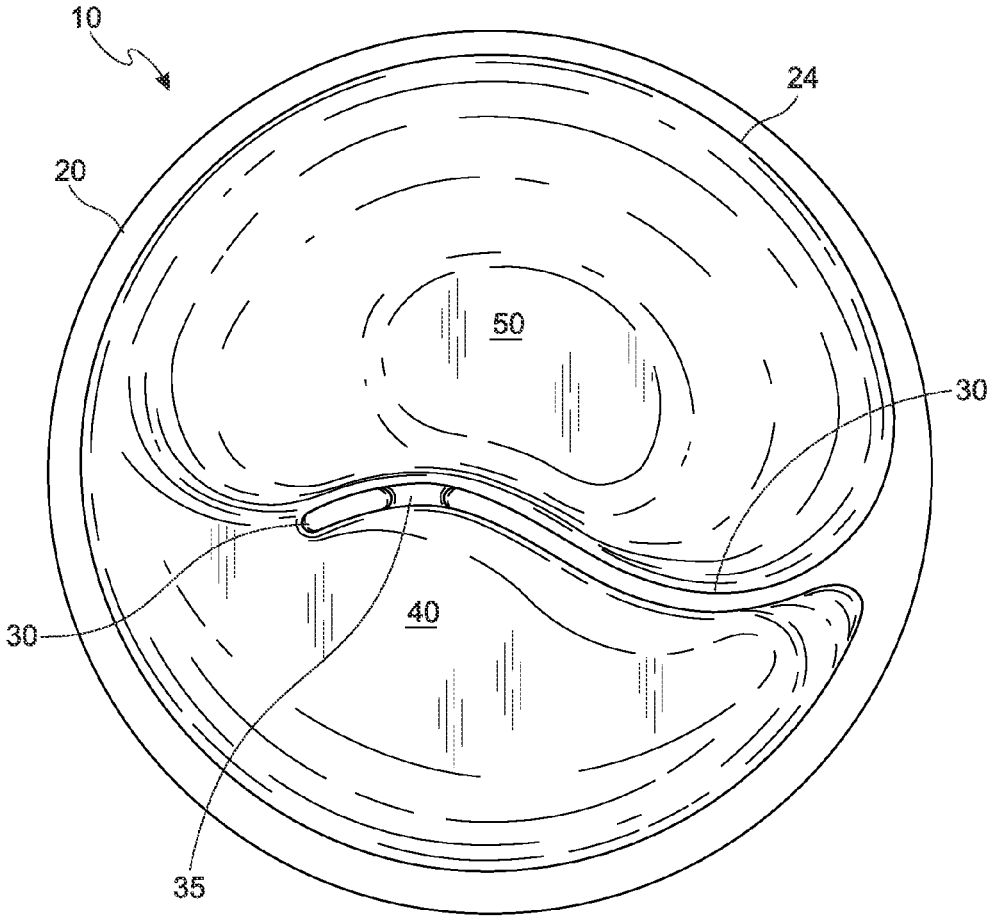
FIG. 2 illustrates a top view of the preferred embodiment of the present invention.

Now referring to FIG. 2, a top view of the preferred embodiment of the present disclosure is shown. As referenced supra, this figure illustrates rim 20, inner surface 24, first area 40, second area 50 and guide rail 30. Additionally, notch 35 in guide rail 30 can be seen which is wide enough to hold the neck of a utensil. As is best seen from this view, second area 50 provides for most of the holding capacity of bowl 10. In the preferred embodiment, second area 50 will make up 60%-80% of bowl 10's capacity, although any size ratio between these areas could be envisioned. In an alternate embodiment of bowl 10, the sidewalls of inner surface 24 in each area, 40, 50 may be marked with fill lines to indicate capacity levels.

Figure 3:
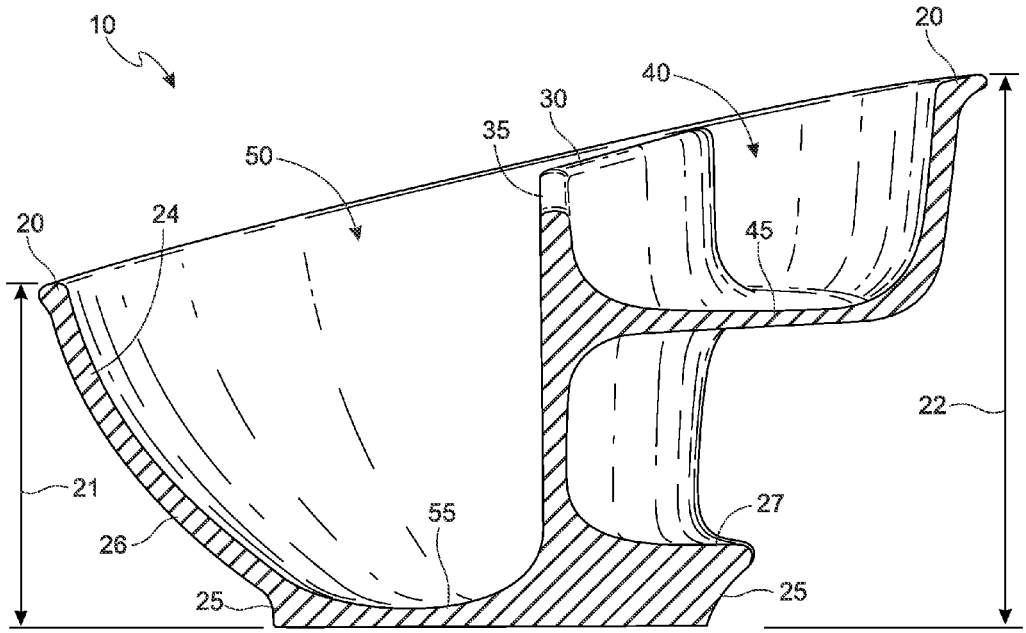
FIG. 3 illustrates a cross sectional side view of the preferred embodiment of the present invention.

Now referring to FIG. 3, a cross sectional side view of the preferred embodiment of the present invention is shown. In this view, the true shape of guide rail 30 can be appreciated as forming an extension of inner surface 24 that dramatically drops off on one side while keeping a height that is consistent with rim 20. As is shown, the height 22 of rim 20 on the side nearest the first area 40 is greater than the height 21 of rim 20 on the side nearest the second area 50. This causes an asymmetrical shape of the bowl 10 but also allows the bowl to be more evenly balanced when full. The slope of rim 20 nearest the second area 50 may also be less vertical than the slope of rim 20 nearest the first area 40. This allows for greater ease of use when inserting a spoon or utensil into bowl 10. The bottom of areas 40, 50 can be seen respectively as defining depths 45 and 55. In this particular cross section, first depth 45 is at its highest point, but as other cross sections are taken moving around the circumference of bowl 10, first depth 45 will gradually decrease and eventually become even to second depth 55. The portion of bowl 10 between depths 45, 55 and outer surface 26 may be solid, hollow, partially supported by a structural scaffold or any other consistency known in the art.

Still referring to FIG. 3, in an alternate embodiment of the inside of bowl 10, second area 50 and second depth 55 may actually slightly continue underneath first depth 45 in order to add capacity to bowl 10. Now focusing on the outside of bowl 10, in the preferred embodiment, outer surface 26 will have a smooth, rounded concave shape and further comprise footings 25 at the base. However, many different exterior shapes and surfaces could be utilized while staying within the scope of the present disclosure. For example, outer surface 26 may be straight up and down, slightly convex or even trapezoidal in shape with the bottom being wider than the top in order to provide for better stability. This could allow for the possibility of one bowl stacking upon another one. Outer surface 26 may also further comprise handles, stanchions, grips, or any other common features known in the art.

Figure 4:
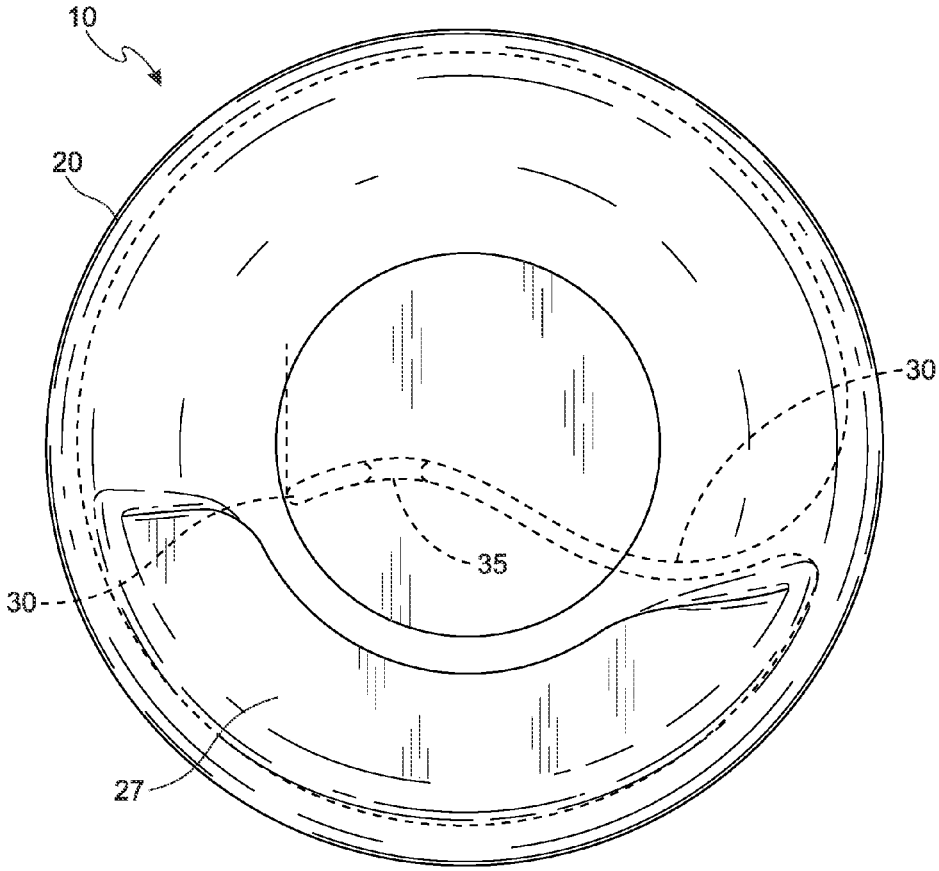
FIG. 4 illustrates a bottom view of the preferred embodiment of the present invention.

Now referring to FIG. 4, a bottom view of the preferred embodiment of the present invention is shown. The underside of rim 20 is shown connecting to outer surface 26. From this particular view, a key component of outer surface 26 comprising a groove 27 is shown. Groove 27 is an indent, notch, groove or cleft in bowl 10 on the same side as second area 40 (not shown). It carves out a space in what would have been a largely solid area between the bottom inner surface of second area 40 (not shown) and outer surface 26. Groove 27 serves the dual purpose of aiding in a manufacturing process that utilizes injection molding, where thick areas require more time and are costly, as well as providing a more convenient way to hold bowl 10 than at rim 20. This is true because when full most of the weight will be in second area 50 of bowl 10. In the preferred embodiment, with this additional feature, bowl 10 can be held with one hand while the other hand can be used to hold a utensil. Ideally, groove 27 will be slightly larger than a child's thumb but could be conceived to be almost any size in order to accommodate a user's hand. As a caveat, in FIG. 4, necessary components such as footings 25 and alternate or optional features such as handles or grips are not present for the sake of simplicity and clarity.

The function of bowl 10 can be appreciated fairly quickly but for clarification purposes its use will be briefly described. In this example, the two ingredients cereal and milk will be used for demonstrative purposes. In order to gradually mix the cereal and milk using bowl 10, the milk should first be poured into the deeper second area 50. Then a dry cereal can be poured on the other side of guide rail 30 into first area 40. It can be noted that the order of these steps is usually the opposite of the normal procedure. Guide rail 30 will be high enough to prohibit cereal from spilling over and have a cupped shape as previously described. To begin mixing, one would simply use a utensil to push some of the cereal around guide rail 30. It would slide down inner surface 26 until it reaches the milk. This allows only the portion of cereal that will be eaten immediately to soak up milk while the rest remains dry. This is due to the fact that first depth 45 is higher than second depth 55. In between bites, the user can rest their utensil on notch 35 within guide rail 30. The height of rim 20 decreases from height 22 to height 21 to provide stability because the milk level should not rise above first depth 45. Rim 20 is also more sloped around second area 50 in order to more easily engage and disengage the utensil. Bowl 10 can also easily be held by the outer surface surrounding wet area 50 and groove 27, just beneath first area 40.

The present invention includes any novel feature or combination of features disclosed herein either explicitly or any generalization thereof. While the invention has been described with respect to specific examples including presently preferred modes of carrying out the invention, those skilled in the art will appreciate that there are numerous variations and permutations of the above described apparatus. Thus, the spirit and scope of the invention should be construed broadly as set forth in the appended claims.

What is claimed is:

1. A bowl for gradually mixing wet and dry ingredients comprising: an outer surface; a spiral, downward-sloping inner surface located within the outer surface; guide rail attached to the inner surface at a first end of the guide rail and extending partially across the bowl; a first area defining a first depth from a rim located on a first side of the guide rail; a second area defining a second depth from the rim located on a second side of the guide rail, the second area joining the first area at a second end of the guide rail, and the inner surface of the second area is lower than the inner surface of the first area; a groove located on the outer surface below the first area; and at least one footing on a lower portion of the outer surface.

2. The bowl of claim 1, a wherein rim is atop the inner surface and decreases in height near the second area.

3. The bowl of claim 1, wherein the second area comprises 60%-80% of the capacity of the bowl.

4. The bowl of claim 1, wherein both the outer surface and the inner surface near the second area are more horizontally sloped than the outer surface and the inner surface near the first area.

5. The bowl of claim 1, wherein the groove can accommodate a child's hand.

6. The bowl of claim 1, wherein the outer surface is convex in shape.

7. The bowl of claim 1, wherein the inner surface is continuous, uniform and smooth.

8. The bowl of claim 1, wherein the guide rail further comprises a notch at least the width of a neck of a utensil.

9. The bowl of claim 1, wherein the guide rail extends across at least one third of the width of the bowl.

10. The bowl of claim 1, wherein the guide rail extends across ninety percent of the width of the bowl.

11. The bowl of claim 1, wherein the second area extends at least partially underneath the first area.

12. A method of using the device of claim 1 comprising the steps of: holding the bowl by the outer surface and the groove; pouring a wet ingredient into the wet area; pouring a dry ingredient into the dry area; pushing some of the dry ingredient around the guide rail, down the inner surface and into the wet area; and consuming the some of the dry ingredient.

13. The method of claim 12 further comprising the step of resting a utensil on a notch located on the guide rail.

14. The method of claim 12 further comprising the step of waiting at least half an hour before consuming the some of the dry ingredient.

15. The method of claim 12, further comprising resting the bowl on an at least one footing.

16. The method of claim 12, further comprising pouring additional wet ingredient as needed.

17. The bowl of claim 1, wherein the guide rail is curved.

18. The bowl of claim 1, wherein both the outer surface and the inner surface near the second area are as evenly sloped as the outer surface and the inner surface near the first area.

19. The bowl of claim 1, wherein the second depth greater than the first depth.

20. The bowl of claim 1, wherein the groove is directly below the dry area.

* * * * *